United States Patent [19]

Trevaskis et al.

[11] 4,119,062

[45] Oct. 10, 1978

[54] AUTOMOTIVE HYDROCARBON AND WATER VAPOR INJECTOR SYSTEM AND UNIVERSAL HOSE CONNECTOR MEANS FOR SAME

[76] Inventors: William T. Trevaskis, 3674 Colonial Ave., Los Angeles, Calif. 90066; William J. Olson, 8262 DePalma St., Downey, Calif. 90241

[21] Appl. No.: 667,503

[22] Filed: Mar. 17, 1976

[51] Int. Cl.[2] ..... F02D 19/00

[52] U.S. Cl. ..... 123/25 R; 123/119 A; 261/18 A

[58] Field of Search ..... 123/25 R, 25 A, 25 B, 123/25 D, 25 L, 119 A; 261/18 A; 285/5, 189, 192, 197–199, 260

[56] References Cited

U.S. PATENT DOCUMENTS

| | | | |
|---|---|---|---|
| 2,760,824 | 8/1956 | Leadbetter | 285/192 X |
| 2,935,341 | 5/1960 | Steinen | 285/192 X |
| 3,716,040 | 2/1973 | Herpin | 123/25 R X |
| 3,856,901 | 12/1974 | Neumann et al. | 123/25 R X |
| 3,885,743 | 5/1975 | Wake | 285/197 X |
| 3,891,150 | 6/1975 | Hoff et al. | 285/197 X |
| 3,933,170 | 1/1976 | Olson, Jr. | 285/197 X |

*Primary Examiner*—Charles J. Myhre
*Assistant Examiner*—Ira S. Lazarus
*Attorney, Agent, or Firm*—Blakely, Sokoloff, Taylor & Zafman

[57] ABSTRACT

A simplified methanol or other hydrocarbon water-vapor injection system and kit for installing it with a minimum of part and effort are provided. A universal hose connector which precludes the necessity for cutting existing hoses on the automobile engine or any hose to which it is desired to connect another is also provided. This connector is constructed to pierce one or both walls of the hose into which connection is desired and place a metering orifice within that hose to thereby inject vapors or the like therein at predetermined rates and reduce vacuum pressure in side of the hose and reservoir of the injector system.

9 Claims, 7 Drawing Figures

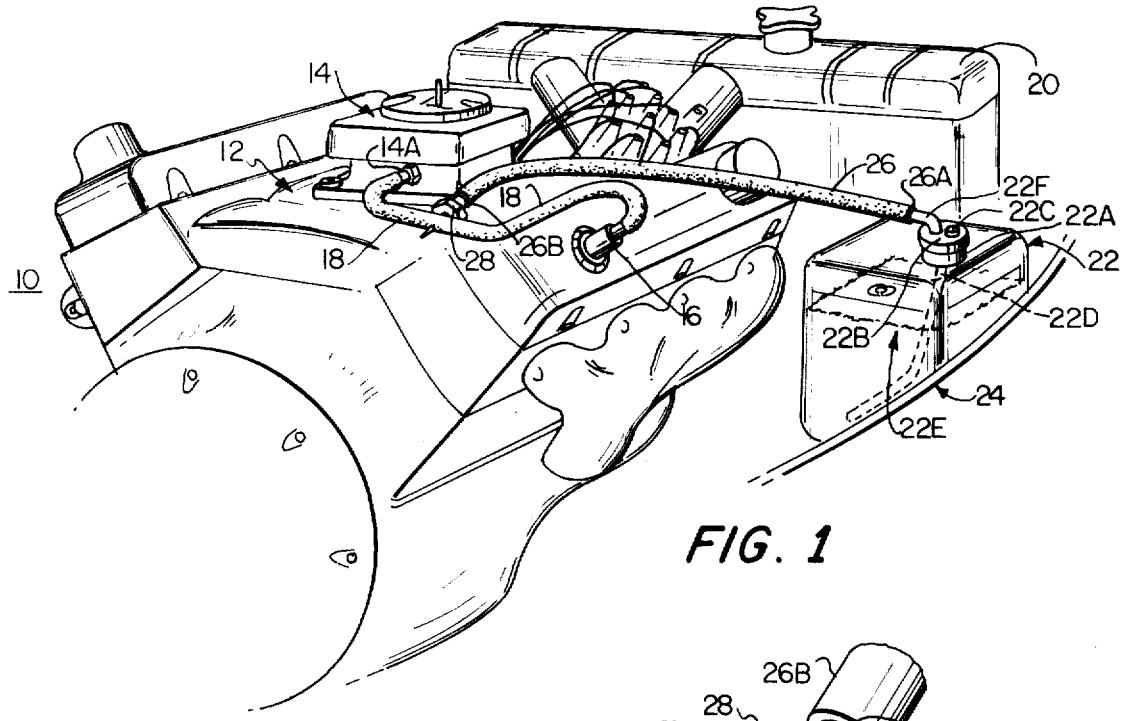
FIG. 1
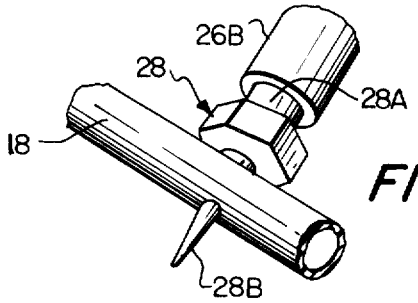
FIG. 2
FIG. 4A
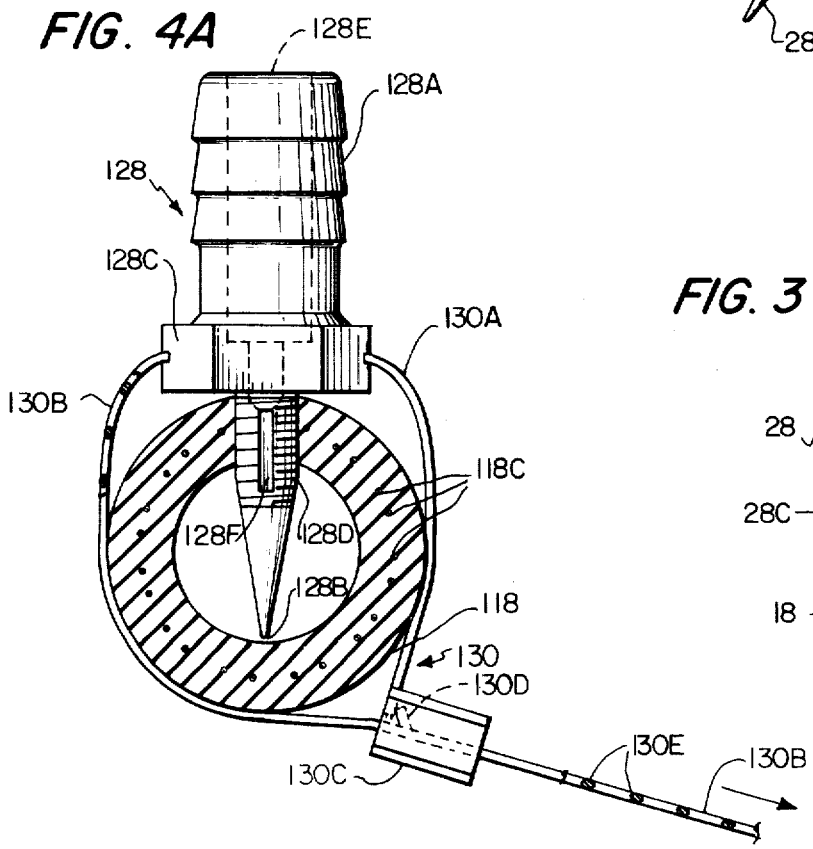
FIG. 3
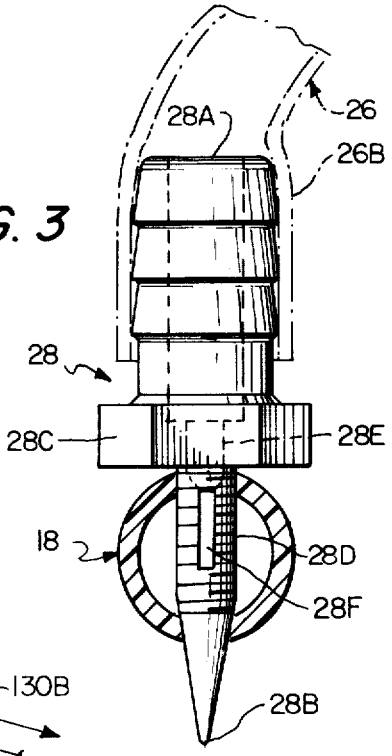

AUTOMOTIVE HYDROCARBON AND WATER VAPOR INJECTOR SYSTEM AND UNIVERSAL HOSE CONNECTOR MEANS FOR SAME

NATURE OF THE INVENTION

This invention relates to methanol or other hydrocarbon and water-vapor injection systems for internal combustion engines and to universal hose couplings for adapting same to existing internal combustion engines and pollution control systems.

BACKGROUND OF THE INVENTION

Methanol and water-vapor injection kits or accessory packages of the prior art require the end user, often a novice or unskilled mechanic to cut existing hoses and the like in automotive pollution control systems, insert T-couplings in these cut lines, adjust needle valves and perform other unfamiliar tasks in order to self-install such devices in his automobile.

Such unfamiliar operations cause consternation and confusion to the purchasers, often requiring them to contract for installation, thus incurring labor costs which defeat or exceed the cost savings which are achieved by buying such equipment directly and installing it by one's own efforts.

OBJECTS OF THE INVENTION

It is an object of the present invention to provide a new and novel methanol or other hydrocarbon water-vapor injector kit for internal combustion engine which obviates the need for cutting existing engine hoses and the like during installation.

It is another object of the present invention to provide a new and novel universal hose coupling and metering orifice device which obviates the need for needle valves and other adjustable flow control devices and further obviates the need for cutting or splicing or reconnecting existing engine hoses.

Yet another object of the present invention is to provide new and novel universal hose coupling devices for both high and low pressure applications.

SUMMARY OF THE INVENTION

The methanol or other hydrocarbon water-vapor injector kit of the present invention includes a reservoir mountable within the engine compartment of a vehicle. A removable outlet cap on the reservoir with a dependent inlet hose extending into the reservoir and an outlet spout adapted to couple to a vapor feed hose is provided in the same general configuration as presently known vehicle radiator water recovery kits. A vapor feed hose extends from the outlet spout into proximity with a selected portion of the positive crankcase ventilation (PCV) hose running from the PCV valve on the engine to an intake on the carburetor of the engine. At this point, a universal hose coupling device is adapted to be placed in the end of the vapor feed hose.

A sharpened and threaded or barbed tip of the coupling, the said tip containing a metering orifice communicating with the hose of the vapor feed hose, is then inserted through the near wall of the PCV hose and the threaded or barbed tip is either screwed or forced into the interior of the PCV hose, locating the metering orifice in the bore of the PCV hose. The vapor feed hose is then coupled to the other end of the universal coupling, whereby the bore of the PCV hose is placed in communication with the reservoir through the metering orifice and vapor feed hose, at a vacuum pressure substantially below the intake manifold vacuum pressure.

The universal hose coupling of the present invention can extend entirely through both walls of a hose tapped thereby, or through one wall only in certain applications, such as high pressure connections, in which integral flexible clamping means can be utilized.

This and other objects of the present invention will become more fully apparent with reference to the following description and drawing of several preferred embodiments of the invention.

BRIEF DESCRIPTION OF THE DRAWINGS

FIG. 1 is a perspective of a methanol water-vapor injector system of the present invention;

FIG. 2 is an enlarged perspective of the connection of the assembled vapor feed hose, PCV hose and universal hose coupling of the present invention;

FIG. 3 is an enlarged side elevation of a preferred embodiment of the universal hose coupling of the present inventicn;

FIG. 4A is a preferred embodiment of a high pressure connection of the universal hose coupling of the present invention;

DETAILED DESCRIPTION OF THE DRAWINGS

Figure 4B:
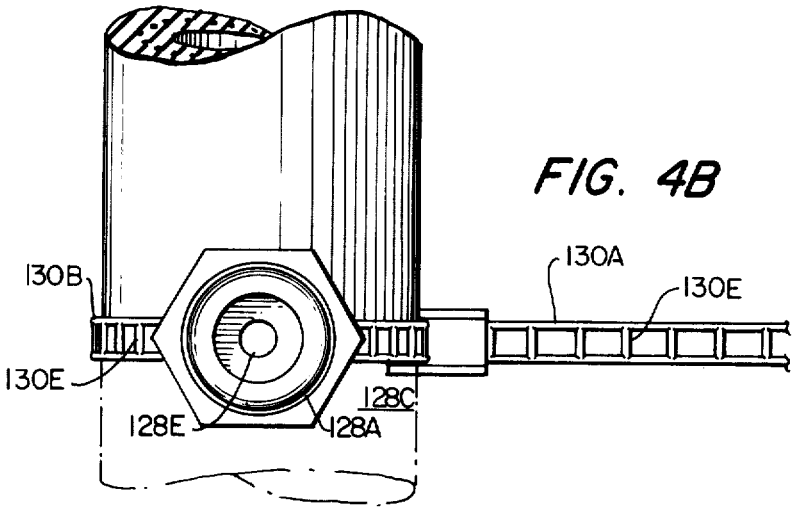
FIG. 4B is a partial top plan view of FIG. 4A illustrating the configuration of a nylon tape or chain type integral clamping means for the hose coupling of FIG. 4A.

Referring now to FIG. 1, the present invention is shown in association with an internal combustion engine 10, having an intake manifold 12, carburetor 14, positive crankcase ventilation (PCV) valve 16 and a PCV hose 18 connected from the PCV valve 16 to an intake fitting 14A on the carburetor 14 in a known configuration. The coolant radiator 20 is also shown to further illustrate the relative orientation of the components of FIG. 1.

The methanol water-vapor injection kit of the present invention includes a high temperature and impact resistant plastic reservoir 22 mounted to a surface 24 in the engine compartment adjacent the engine 10 by any suitable clamping or bracket means.

An access throat 22A is provided on the reservoir 22 on which is mounted a closure cap 22B. Within the top surface of the closure cap 22B is an air inlet fitting 22C which includes an air inlet hose 22D extending from the interior of the cap 22D downward beneath the surface of the methanol hydrocarbon and water mixture 22E in the reservoir 22 to a point adjacent the bottom of the latter. An outlet spout 22F in the top of the cap 22B communicates with the upper portion of the reservoir 22 and provides a hose coupling by which the methanol hydrocarbon and water vapors from the reservoir 22 may be transmitted to the carburetor 14 as will now be more fully described.

Referring jointly to FIGS. 1 and 2, a vapor feed hose 26 of the present invention has one end 26A thereof telescopically coupled over the free end of the outlet spout 22F and its other end 26B coupled to the inlet side 28A of the universal hose connector 28 of the present invention.

The universal hose connector 28 includes a pointed penetrating tip 28B which passes completely through the PCV hose aas will now be more fully described with joint reference to FIGS. 1, 2 and 3.

As shown in FIG. 3, the inlet portion 28A of the universal hose connector 28 is conventionally fluted in either a straight or tapered hose coupling configuration to receive and retain the second end 28B of the vapor feed hose 26.

The mid-portion 28C of the connector 28 is formed like a hex-head nut or other gripping means (such as a wing-nut) to facilitate insertion of the connector 28 into the PCV hose 18. From the mid-portion 28C to the penetrating tip 28B, the connector 28 has a tapered conical shank formed with screw threads 28D over a substantial portion thereof. Thus, when the penetrating tip 28B is forced into one wall of the PCV hose 18 to the point where the screw threads 28D can engage the hose 18, the mid-portion 28C can be engaged by a wrench or the like to force the coupling 28 further into the hose 18 with the result that the penetrating tip 28B ultimately penetrates and passes through the opposite wall of the tube 18 as shown in FIG. 3.

This provides optimum lateral stability to the universal hose connector 28 to preclude it from flexing the hose 18 and either working free or enlarging the penetrated connection point, thereby precluding broken and/or faulty, leaky connections.

The inlet 28A of the connector 28 is provided with an intake bore 28E connecting the interior of the vapor feed hose 26 with the interior of the PCV hose 18. The intake bore 28E terminates in a metering orifice 28F formed in one wall of the tapered and shank portion of the connector 28 where, as shown in FIG. 3, it is disposed in part among the screw threads 28D.

The universal hose connectors 28 may be made from molded nylon or the like, thereby keeping their cost at a minimum. Of course, any suitable materials may be used, as will be more fully described hereinafter, for other applications of the universal hose connector 28.

In operation of the methanol hydrocarbon water-vapor injector system of FIGS. 1, 2 and 3, assuming that the reservoir 22 contains a methanol hydrocarbon and water mixture and the engine 10 is operating, the flow of pollutants through the PCV hose 18 from the PCV valve 16 to the intake 14A of the carburetor 14 induces a suction in the vapor fed hose 26 through the metering orifice 28F and intake 28E, which, in turn, creates a partial vacuum in the top of the reservoir 22 via the vapor outlet spout 22F. This causes the ingestion of air into the reservoir through the air inlet 22C and inlet hose 22D, whereupon the ingested air, bubbles up through the methanol and water mixture in the reservoir 22, causing additional evaporation of the mixture. The resulting vapors are thus drawn off through the outlet spout 22F, vapor feed hose 26, intake bore 28E and metering orifice 28F of the universal hose connector 28 into the interior of the PCV hose 18.

The size of the metering orifice 28F permits the proper amount of vaporized air to be entrained in the flow of pollutants in the PCV hose 18 and thus pass into the carburetor 14 via the intake coupling 14A where the methanol water-vapor mixture ultimately mixes with the fuel mixture to provide cooler burning which enhances engine power and performance.

OTHER EMBODIMENTS OF THE UNIVERSAL HOSE CONNECTOR

For hose connections in which high pressures are encountered, reference is now made to FIGS. 4A and 4B wherein the numerals 128, 128A, 128B–128F denote, respectively, like elements to the numerals 28, 28A, 28B–28F of FIG. 3.

If it is desired not to puncture the off-side of a high pressure hose 118 in which the universal hose connector 128 is inserted, the penetrating tip 128B and threaded section 128D are dimensioned such that complete penetration through the walls of the hose 118 is precluded. Such hoses are usually reinforced with screen or other woven reinforcement 118C as generally indicated, the latter giving greater purchase to the screw threads 128D on the connector 128.

To provide additional stability of the connector 128 in this configuration, there is provided a ratchet type hose clamp 130 which comprises first and second elongated lattice or ladder type straps 130A and 130B integrally affixed or molded into the hexnut portion 128C of the connector 128.

The free end of the strap 130A includes a sliding clamp 130C having a one-way detent 130D internally thereof. The free end of the strap 130B passes through the sliding clamp 130C and the cross-rungs 130E of the strap are engaged by the dog 130D to permit tightening of the two straps 130A, 130B into a snug relationship with the outer periphery of the high pressure tube 118.

Figure 5:
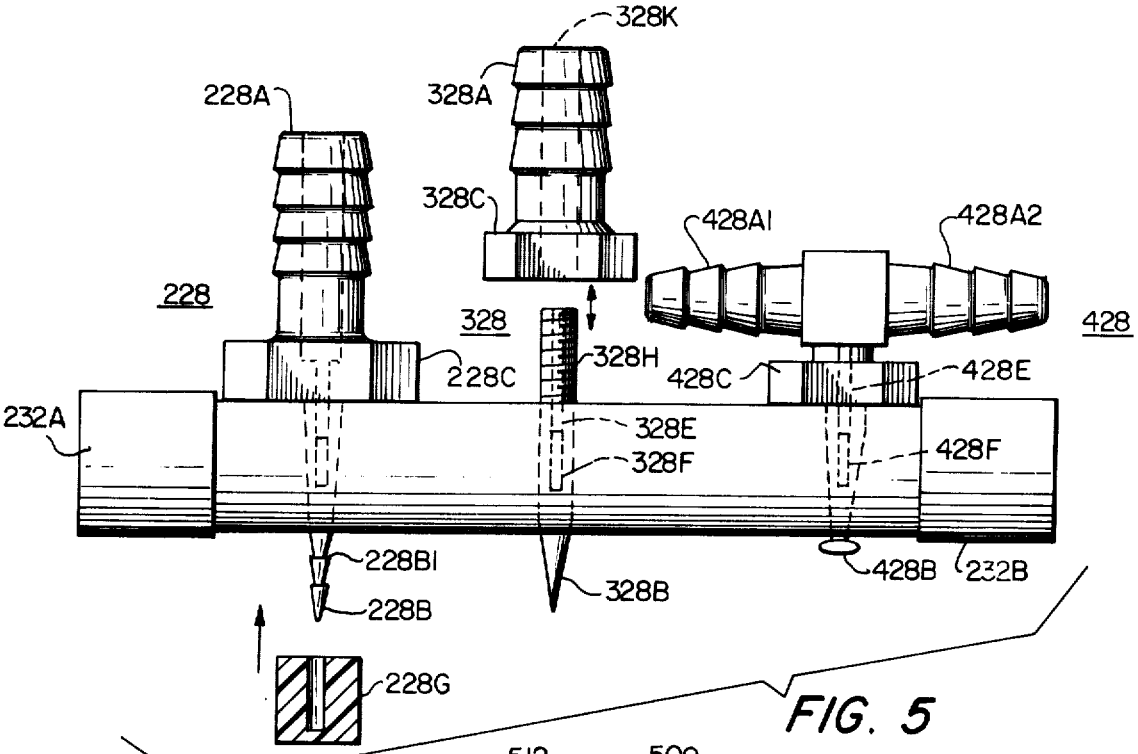
FIG. 5 is a side elevation of additional embodiments of the hose coupling of the present invention illustrating the adaptability of the said hose coupling to manifolding several hose couplings in a common length of hose.

Several alternate embodiments as well as the adaptability of the universal hose connector of the present invention are illustrated in and will now be described with reference to FIG. 5.

A short length of flexible tubing 218 having end closure caps 232A and 232B is provided as a common manifold for three universal hose connectors 228, 328 and 428. The intake coupling portions of these hose connectors are identified as 228A, 328A and 428A1, 428A2, respectively; the penetrating tip portions as 228B, 328B and 428B, respectively; and the hex-nut intermediate portions as 228C, 328C and 428C, respectively.

All of the connectors 228, 328 and 428 are inserted through the hose 218 by penetration through both walls thereof although it is to be understood that the high pressure configuration of FIGS. 4A and 4B can also be used.

The universal hose connector 228 illustrates a barbed configuration of the penetrating tip 228B as illustrated by the one-way barbs 228B1 on the exposed portion thereof. With this embodiment, a nylon lock nut or sleeve 228G is provided to receive the exposed tip portion 228B and be telescopically placed thereon into snug engagement with the adjacent wall of the manifold tube 218.

The universal hose connector 328 illustrates the concept of a removable intake 328A and hex-nut 328C assembly by providing a threaded shank 328H adopted to be threadably received in an internal bore 328K of the intake portion 328A. The shank 328H includes the intake bore 328E and metering orifice 328F of the embodiments of FIGS. 3 and 4A, but provides the capability of affixing various sizes and types of inlet fittings to the universal connector 328 once it has been positioned in the manifold hose 218 to thereby obviate the need for removing the connector 328 once it is placed in the hose 218. Also, the shank 328H can be capped off to close the intake bore 328E if desired.

The universal connector 428 illustrates a T-coupling 428A1, 428A2 coupled to a single intake bore 428E and metering orifice 428F to provide for mixing fluids ingested into the manifold 218 or splitting the flow of fluids leaving same.

The penetrating tip 428B as illustrated, shows the tip in an enlarged melted condition to serve as an integral deterrent to removal or loosening of the connector 428 in the manifold 218.

Figure 6:
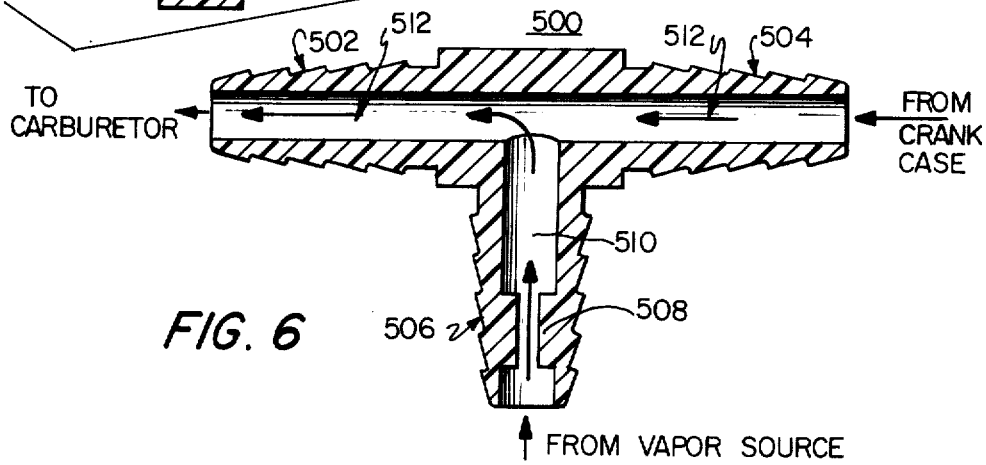
FIG. 6 shows a conventional or tapered T-fitting for hoses in which a metering orifice from the present invention has been provided.

Referring to FIG. 6, a T-coupling 500 having in-line hose fittings 502,504 on the cross-arm of the T and a hose fitting 506 on the leg of the T is shown as including a metering orifice 508 in the leg of the T in a bore 510.

The bore 510 connects with a through-bore 512 in the cross arm of the T-coupling 500 between the in-line fittings 502,504.

Thus as an example of use, a hose between the carburetor and the crankcase in an existing engine can be split and the ends fitted onto the respective in-line fittings 502,504. Then a hose is connected from the fitting 506 to the reservoir of the present invention such as shown at 22 in FIG. 1 to complete the connection.

As can be readily seen from the foregoing specification and drawings, the present invention provides new and novel universal hose connectors and a new and novel methanol hydrocarbon water-vapor injector system and kit for internal combustion engines which is of optimized simplicity both in operation and in installation. Furthermore, the universal hose connectors of the present invention are adaptable to a wide variety of uses and provide a versatile choice of structures and configurations readily adapting same to such uses.

The present invention may be modified as would occur to one of ordinary skill in the art without departing from the spirit and scope of the present invention.

We claim:

1. For use in combination with an internal combustion engine having a carburetor and a vacuum hose attached to an inlet fitting on said carburetor vacuum, a kit means providing a hydrocarbon and water-vapor injection system for a said engine, comprising:

reservoir means for receiving and containing hydrocarbon and water at a position adjacent said engine;

closure means on an upper side of said reservoir means having an air ingestion inlet means transmitting ingested air to a lowermost portion of said reservoir and a vapor outlet spout;

a vapor feed hose for connection between said vapor outlet spout and said vacuum hose on said engine; and a universal hose connector means for connecting one end of said vapor feed hose to said vacuum hose, said connector means comprising;

an inlet fitting connectable within said vapor feed hose;

an elongated, tapered and pointed penetrating shank extending from said inlet fitting so shaped and so proportioned as to pierce at least one wall of said vacuum hose;

an intermediate portion of said connector engaging the said wall of said vacuum hose when said penetrating shank is fully inserted therein;

an intake bore formed in and extending through said inlet fitting into said penetrating shank; and, a metering orifice in said shank communicating with said intake bore so that the interior of said vacuum hose communicates with said bore through said orifice, said metering orifice for controlling the introduction of injected vapors into said vacuum hose at a predetermined rate, said orifice providing reduced vacuum pressure in said vapor feed hose and in said reservoir means;

whereby said vapor feed hose and said reservoir means are subjected to reduced pressures when compared to the pressure on said vacuum hose.

2. The invention defined in claim 1, wherein said penetrating shank is sufficiently elongated to pass through both walls of said pollutant conveying hose.

3. The invention defined in claim 1, wherein said intermediate portion comprises an integral nut and said penetrating shank is formed with screw threads.

4. The invention defined in claim 3, wherein said penetrating shank is elongated to pass through both walls of said vacuum hose.

5. The invention defined in claim 3, wherein said universal hose connector further includes flexible strap clamp means integrally extending from said nut means for snugly securing said connector to said vacuum hose.

6. The invention defined in claim 2, wherein said kit means further includes fastener means for telescopically receiving the outermost tip of said penetrating shank in juxtaposition with the wall of a said vacuum hose.

7. The invention defined in claim 6, wherein said penetrating shank is barbed to preclude withdrawal from said vacuum hose after penetration of the walls thereof.

8. The invention defined in claim 1, wherein said inlet portion of said universal connector means includes an externally threaded shank including said intake bore and an internally threaded hose coupling removable threaded over said shank.

9. A hydrocarbon and water-vapor injection system for use with an internal combustion engine having an carburetor and a vacuum hose attached to an inlet fitting on said carburetor comprising:

a reservoir for receiving and containing hydrocarbon and water at a position adjacent to said engine;

closure means on an upper side of said reservoir having an air ingestion inlet means transmitting ingested air to a lowermost portion of said reservoir;

said closure means including a vapor outlet spout;

a vapor feed hose for connecting between said vapor outlet spout and said vacuum hose on said engine;

a universal hose connector for connecting one end of said vapor feed hose to said vacuum hose, said connector means comprising:

an inlet fitting connectable within said vapor feed hose;

an elongated, tapered and pointed penetrating shank extending from said inlet fitting so shaped and so proportioned as to pierce the walls of said vacuum hose and extend therethrough, said shank including externally disposed threads which engage at least the first pierced of said pierced walls for securing said connector to said vacuum hose;

an intake bore formed in and extending through said inlet fitting into said shank for providing communications between said vapor feed hose and the interior of said vacuum hose;

wherein said system may be readily installed.

* * * * *